US007004601B2

(12) United States Patent
Aguglia

(10) Patent No.: US 7,004,601 B2
(45) Date of Patent: Feb. 28, 2006

(54) SIGNALING DEVICE FOR SIGHTING SYSTEMS, FOR EXAMPLE FOR RESCUE CRAFTS IN THE NAUTICAL FIELD AND THE LIKE

(75) Inventor: Jorge Miguel Aguglia, Lecce (IT)

(73) Assignee: S.I.E.M. S.r.l., (IT)

( * ) Notice: Subject to any disclaimer, the term of this patent is extended or adjusted under 35 U.S.C. 154(b) by 0 days.

(21) Appl. No.: 10/772,831

(22) Filed: Feb. 5, 2004

(65) Prior Publication Data

US 2004/0223322 A1 Nov. 11, 2004

(30) Foreign Application Priority Data

May 6, 2003 (EP) ..... 03425288

(51) Int. Cl.
*B60Q 1/02* (2006.01)
*B60Q 1/06* (2006.01)

(52) U.S. Cl. ..... 362/212; 362/211; 362/540; 362/542; 362/477

(58) Field of Classification Search ..... 362/211, 362/212, 236, 240, 244, 267, 540, 542, 477
See application file for complete search history.

(56) References Cited

U.S. PATENT DOCUMENTS

| | | | | |
|---|---|---|---|---|
| 1,877,785 | A | 9/1932 | Andrews | |
| 3,569,693 | A * | 3/1971 | Lindae et al. | 362/214 |
| 4,384,268 | A * | 5/1983 | Matthewman | 340/985 |
| 4,605,877 | A | 8/1986 | Cho et al. | |
| 5,416,670 | A * | 5/1995 | Authier | 362/34 |
| 5,711,591 | A * | 1/1998 | Jordan | 362/477 |
| 6,086,220 | A | 7/2000 | Lash et al. | |
| 6,808,291 | B1 * | 10/2004 | Aylward et al. | 362/205 |

FOREIGN PATENT DOCUMENTS

| | | |
|---|---|---|
| GB | 2 224 343 | 5/1990 |
| GB | 2 354 576 | 3/2001 |

* cited by examiner

*Primary Examiner*—Thomas M. Sember
*Assistant Examiner*—James W Cranson, Jr.
(74) *Attorney, Agent, or Firm*—Greer, Burns & Crain, Ltd.

(57) ABSTRACT

A signaling device for sighting systems, for example for rescue crafts in the nautical field and the like, comprising at least two lamps arranged so that their respective filaments are mutually perpendicular, so as to achieve a circular luminous emission that is uniform over 360°.

10 Claims, 1 Drawing Sheet

SIGNALING DEVICE FOR SIGHTING SYSTEMS, FOR EXAMPLE FOR RESCUE CRAFTS IN THE NAUTICAL FIELD AND THE LIKE

BACKGROUND OF THE INVENTION

The present invention relates to a signaling device for sighting systems, for example for rescue crafts in the nautical field and the like. More particularly, the invention relates to an intermittent signaling device.

As is known, external signaling devices suitable to be used for rescue crafts such as life rafts for watercraft are currently commercially available.

However, these signaling devices have a light distribution system that is provided by using a single lamp whose brightness, emitted by the single filament of the lamp, produces a given light field, leaving substantially uncovered two sectors in which shadow zones are formed.

Essentially, with a single filament and therefore a single lamp, two substantially opposite lighting regions are produced which extend from the body of the lamp, with two shadow sectors that are located at the respective north and south poles when one considers a sphere whose light field is determined by the lighting of the lamp.

This is of course a drawback in signaling devices that must be used in sighting systems, for example for rescue crafts, in which the primary purpose is obviously to be sighted at the greatest possible distance so as to allow the recovery of shipwrecked persons.

Accordingly, existing signaling devices, despite being accepted and commonly used by users, do not offer the assurances of reliability that make the signaling device absolutely suitable for use in the nautical field. Furthermore, if the single filament breaks, the device is unusable and therefore the rescue system is no longer available.

SUMMARY OF THE INVENTION

The aim of the present invention is to provide a signaling device for sighting systems, for example for rescue crafts, that provides lighting over a field of substantially 360°, without leaving unwanted shadow zones.

Within this aim, an object of the present invention is to provide a signaling device that allows more effective sighting from a distance of the life raft or rescue craft on which the signaling device is fitted.

Another object of the present invention is to provide a signaling device that can be used outside the raft.

Another object of the present invention is to provide a signaling device that is highly reliable, relatively simple to manufacture, and at competitive costs.

This aim and these and other objects that will become better apparent hereinafter are achieved by a signaling device for sighting systems, for example for rescue crafts in the nautical field and the like, characterized in that it comprises at least two lamps arranged so that their respective filaments are mutually perpendicular, so as to achieve a circular luminous emission that is uniform over 360°.

BRIEF DESCRIPTION OF THE DRAWINGS

Further characteristics and advantages of the invention will become better apparent from the description of a preferred but not exclusive embodiment of the device according to the present invention, illustrated by way of non-limitative example in the accompanying drawings, wherein.

DESCRIPTION OF THE PREFERRED EMBODIMENTS

Figure 1:
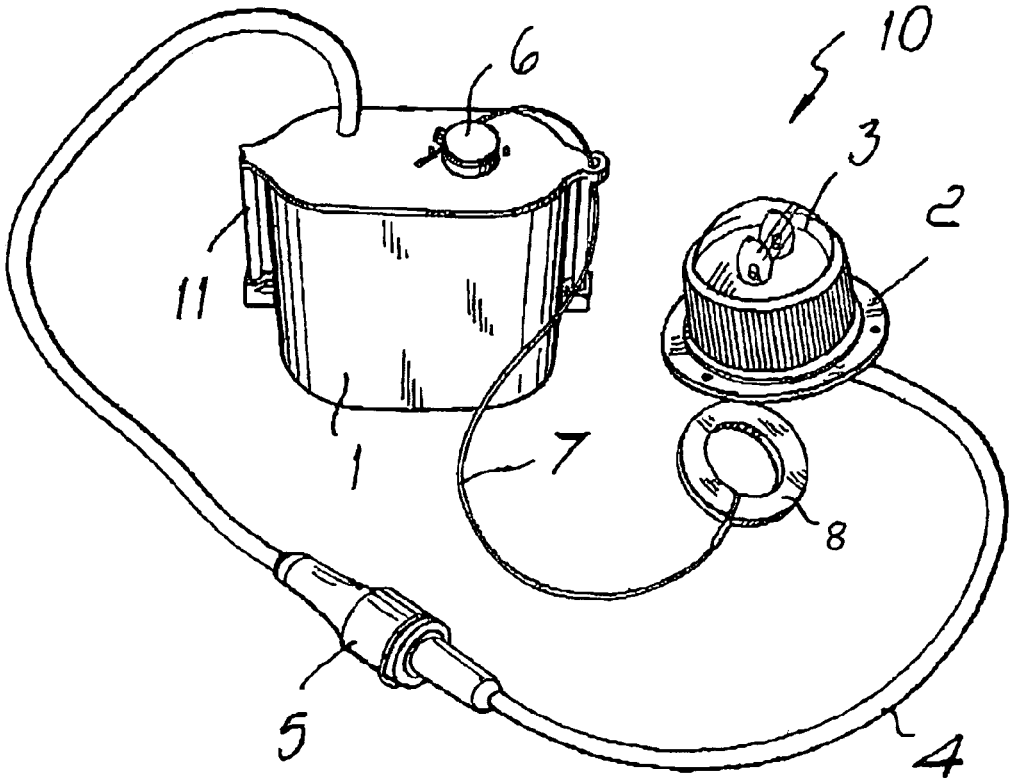
FIG. 1 is a perspective view of the signaling device according to the present invention.
Figure 2:
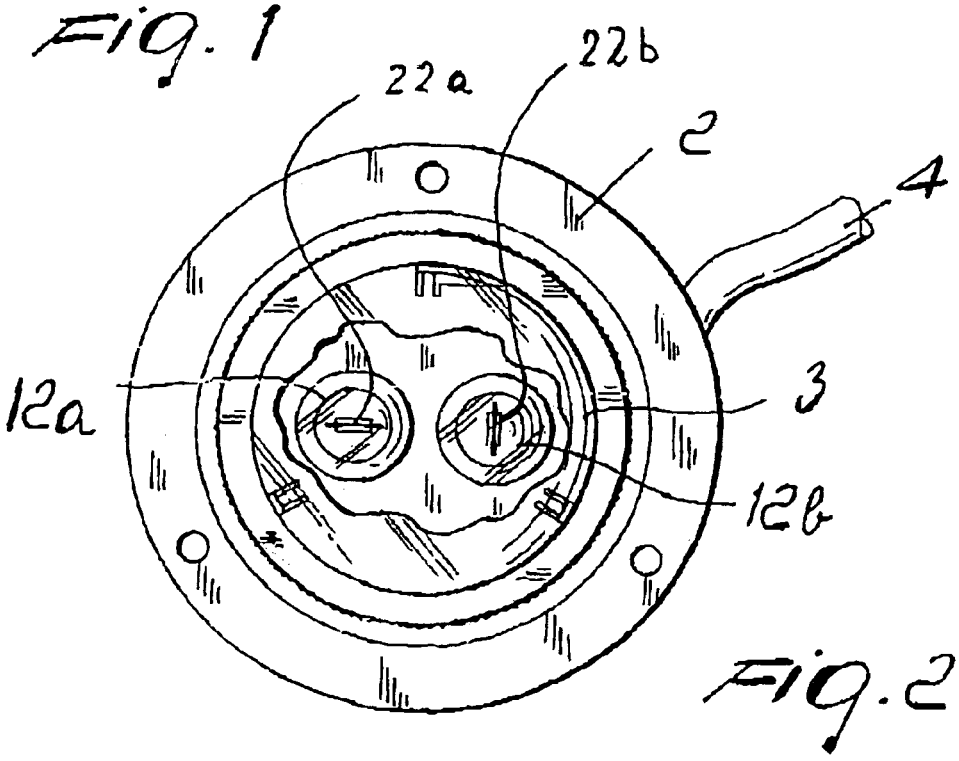
FIG. 2 is a top plan view of the arrangement of the lamps of the signaling device according to the present invention.

With reference to the figures, the signaling device according to the present invention, generally designated by the reference numeral 10, comprises a body 1, which contains batteries for supplying power to the device and is suitable to be fixed to a life raft by means of a pair of lateral supports 11.

The body of the signaling device is then connected to a cylindrical body 2 provided with a fixing flange for the connection of the body 2 to the outside of the group rescue craft.

The hermetic closure of the body 2 occurs by means of a dome 3, inside which at least two lamps 12*a* and 12*b* are respectively accommodated; the arrangement of said lamps is explained hereinafter.

The dome 3 is preferably made of polycarbonate, so as to transmit light on the entire upper hemisphere, and is provided in a downward region with a flange for fixing to the outer surface of the rescue craft.

The body 2 and the body 1 are connected by means of a cable 4 and a sealed connector 5 of the hermetic type. This kind of connection facilitates both installation during the assembly of the lamp and the replacement of the battery pack accommodated within the body 1.

Conveniently, a power-on switch 6, arranged at the top of the body 1 for accommodating the battery pack, is provided in order to switch on and off the lighting device. The switch 6 is conveniently of the mechanical rotary type, and in the case of automatically inflatable raft the switch 6 is provided with a receptacle that allows to wind up an actuation cord 7 that is provided with a ring 8 at one end. The automatic opening of the raft pulls the cord 7, which in turn rotates the switch 6, causing the automatic lighting of the lamps 12*a* and 12*b* accommodated within the dome 3.

The body 2 also accommodates, in addition to the lamps of the signaling device, the electronic control circuit.

A particularity of the invention consists of the fact that the lamps 12*a* and 12*b* arranged within the dome 3 are located at the center of the dome so that their respective filaments 22*a* and 22*b* are arranged substantially at right angles to each other. This improves the emission of light over the entire upper hemisphere, lighting the shadow zones that are typical of known types of lighting devices, and also increases the reliability of the devices. With two lamps, the probability that they both fail simultaneously is extremely low.

Preferably, the lamps 12*a* and 12*b* are of the incandescent type.

The arrangement of the two lamps at right angles to each other therefore allows one to solve the drawback of shadow zones produced by using a single lamp like the known types of devices.

Conveniently, it is also possible to use more than two lamps, always arranging them however with their filaments at right angles to each other, so as to cover over 360° the entire upper hemisphere without resorting to the use of lenses that can provide the same result by means of an optical effect.

Furthermore, the use of two lamps simultaneously, for an equal power level, allows one to have an increase in luminous intensity or, for an equal luminous intensity, a longer reuse endurance.

The provision of a circular light emission that is uniform over 360° is fundamental, since in emergency situations and specifically in the case of searches at sea, the success of the rescue operation can be determined by the sighting of the life raft in the shortest possible time, in order to be able to rescue shipwrecked persons.

In practice it has been found that the device according to the present invention fully achieves the intended aim and objects.

The device thus conceived is susceptible of numerous modifications and variations, all of which are within the scope of the appended claims.

All the details may further be replaced with other technically equivalent elements. In practice, the materials used, as well as the contingent shapes and dimensions, may be any according to requirements and to the state of the art.

The disclosures in EPA No. 03425288.2 from which this application claims priority are incorporated herein by reference.

What is claimed is:

1. A signaling device for sighting systems, comprising signaling means and a body that is suitable to be connected externally to a rescue craft and to accommodate power supply means, said body being connected to the signaling means by way of a connecting cable, wherein said signaling means comprises at least two lamps, each having a respective filament, said filaments being perpendicular to each other, and said body is provided with switch means comprising a cord that is wound around the switch means for automatic actuation thereof upon opening of the rescue craft.

2. The device of claim 1, wherein said at least two lamps are incandescent lamps.

3. The device of claim 1, further comprising a protection dome that is made of a material transparent to light, and wherein said at least two lamps are accommodated within said dome.

4. The device of claim 3, wherein said dome made of light-transparent material is provided, in a downward region, with a flange for fixing to an outer surface of said rescue craft.

5. The device of claim 3, wherein said at least two lamps are arranged substantially at the center of said dome made of light-transparent material.

6. The device of claim 3, wherein said body suitable to accommodate power supply means and said dome in which said at least two lamps are accommodated are connected by way of said connecting cable with a hermetic sealed connector interposed.

7. A signaling device for sighting systems, comprising:

signaling means;

a body that is suitable to be connected externally to a rescue craft and to accommodate power supply means; and a protection dome that is made of material transparent to light and is provided, in a downward region, with a flange for fixing to an outer surface of said rescue craft;

wherein said signaling means comprises at least two lamps, each having a respective filament, said filaments being perpendicular to each other, said at least two lamps being accommodated within said dome; and wherein said body is connected to the signaling means by way of a connecting cable.

8. The device of claim 7, wherein said body is provided with switch means comprising a cord that is wound around the switch means for automatic actuation thereof upon opening of the rescue craft.

9. A signaling device for sighting systems, comprising at least two lamps each having a respective filament, and wherein said respective filaments are perpendicular to each other, so as to achieve a circular luminous emission that is generally uniform over a 360° emission field.

10. The device of claim 9, further comprising a signaling means and a body that is suitable to be connected externally to a rescue craft and to accommodate power supply means, said body being connected to the signaling means by way of a connecting cable, and wherein said signaling means comprise said at least two lamps, arranged with the respective filaments being perpendicular to each other, so as to obtain a circular luminous emission that is generally uniform over a 360° emission field.

* * * * *